US009618299B1

(12) United States Patent
Gingrich

(10) Patent No.: US 9,618,299 B1
(45) Date of Patent: Apr. 11, 2017

(54) ADAPTOR FOR ATTACHING TO THE RAIL SYSTEM ON A FIREARM

(71) Applicant: KA-BAR Knives, Inc., Olean, NY (US)

(72) Inventor: Justin Dean Gingrich, Wade, NC (US)

(73) Assignee: KA-BAR Knives, Inc., Olean, NY (US)

( * ) Notice: Subject to any disclaimer, the term of this patent is extended or adjusted under 35 U.S.C. 154(b) by 0 days.

(21) Appl. No.: 14/816,134

(22) Filed: Aug. 3, 2015

(51) Int. Cl.
*F41C 27/18* (2006.01)

(52) U.S. Cl.
CPC ..... *F41C 27/18* (2013.01)

(58) Field of Classification Search
CPC ..... F41C 27/00; F41C 27/18
USPC ..... 42/86
See application file for complete search history.

(56) References Cited

U.S. PATENT DOCUMENTS 3,613,283 A * 10/1971 Mozey, Jr. ..... F41C 27/18 30/296.1
4,689,911 A * 9/1987 White ..... F41A 19/39 42/1.06
6,209,250 B1 * 4/2001 Mills ..... F41C 27/00 42/106
6,385,892 B1 * 5/2002 Vendetti ..... F41C 27/00 42/86
6,725,593 B1 * 4/2004 Harris ..... F41C 27/18 42/86
6,968,642 B1 * 11/2005 Leung ..... F41C 23/16 30/162
7,735,255 B1 * 6/2010 Kincaid ..... F41G 1/35 362/110
8,322,066 B2 * 12/2012 Westra ..... F41G 11/004 42/146
8,763,295 B2 * 7/2014 Trimble ..... F41A 23/02 42/72
9,175,924 B1 * 11/2015 Williford ..... F41G 11/001
9,228,801 B2 * 1/2016 Hosz ..... F41C 27/00
9,234,722 B2 * 1/2016 Rice ..... F41C 27/16
2007/0074437 A1 * 4/2007 Compton ..... F41A 35/06 42/12
2014/0190061 A1 * 7/2014 Griffin ..... F41C 27/06 42/105

FOREIGN PATENT DOCUMENTS

IT WO 2007128346 A1 * 11/2007 ..... F41C 27/18

OTHER PUBLICATIONS

Nick Leghorn, Gun Review: M79 Grenade Launcher, Oct. 18, 2013, The Truth About Guns, p. 5.*

* cited by examiner

*Primary Examiner* — Stephen M Johnson
*Assistant Examiner* — Joshua Semick
(74) *Attorney, Agent, or Firm* — Phillips Lytle LLP; David L. Principe

(57) ABSTRACT

An arm is attached to a mounting body at a first attachment. The arm is configured and arranged to move between an open position and a closed position. The arm has a first surface that in combination with a second surface on the mounting body forms a cavity for holding a fixed blade knife in a locked position when the arm is attached to the mounting body at a second attachment.

21 Claims, 7 Drawing Sheets

ADAPTOR FOR ATTACHING TO THE RAIL SYSTEM ON A FIREARM

TECHNICAL FIELD

The present invention relates generally to the field of weapons, and more particularly to an adaptor for use with a rail system on a firearm and a method of using such an adaptor.

BACKGROUND ART

Current military bayonets designed with the M4 Carbine/M16 platform are limited as to the weapons that can be mounted to the outside of the platform. Mounts for these bayonets usually consist of a lug that is fixed to the barrel of the firearm. The lug protrudes down from barrel where it combines with the muzzle ring of the bayonet. The muzzle ring slides over the muzzle and allows the lug to fix the bayonet in place. This design limits the mounting of current bayonets to weapons that have a sufficient length of exposed barrel to accommodate the length of the handle on the bayonet and that have the barrel circumference to accommodate the muzzle ring. What is needed is an adaptor that overcomes these drawbacks.

BRIEF SUMMARY OF THE INVENTION

With parenthetical reference to the corresponding parts, portions or surfaces of the disclosed embodiment, merely for the purposes of illustration and not by way of limitation, the present invention provides an adaptor (10) for receiving a fixed blade knife (160). The adaptor (10) includes a mounting body (13) configured to operatively attach to a rail system (157) of a firearm (206). An arm (19) is attached to the mounting body (13) at a first attachment (22). The arm (19) is configured and arranged to move between an open position and a closed position. The arm (19) has a first surface (43) that in combination with a second surface (58) on the mounting body (13) forms a cavity (59) for holding the fixed blade knife (160) in a locked position when the arm (19) is attached to the mounting body (13) at a second attachment (41).

The adaptor (10) may further comprise the arm (19) having a first end (28) that is pivotally attached to the mounting body (13) at the first attachment (22).

The adaptor (10) may further comprise the first surface (43) having a recessed portion (46) for receiving a butt cap (175) on the knife (160).

In another aspect, one of the arm (19) and the mounting body (13) include at least one locking tab (37).

In another aspect, one of the arm (19) and the mounting body (13) have an opening (40) for receiving the locking tab (37) therethrough.

The adaptor (10) may further comprise the first surface (43) and the second surface (58) having at least one groove (49) defined therein for receiving at least one O-ring (178) disposed around the handle (166) of the knife (160).

The adaptor (10) may further comprise the mounting body (13) receiving a cooperating member (88) such that a portion of the mounting body (13) and a corresponding portion of the cooperating member (88) form a channel (106) when the cooperating member (88) is attached to the mounting body (13).

In another aspect, the mounting body (13) has an edge disposed adjacent to a recessed portion forming a shoulder (61).

In another aspect, the arm (19) has an edge configured to engage with the shoulder (61) when the arm (19) is attached to the mounting body (13).

In another aspect, the arm (19) includes longitudinally spaced protrusions (130) configured to grip the handle (166) of a knife (160).

DESCRIPTION OF THE PREFERRED EMBODIMENTS

Figure 1:
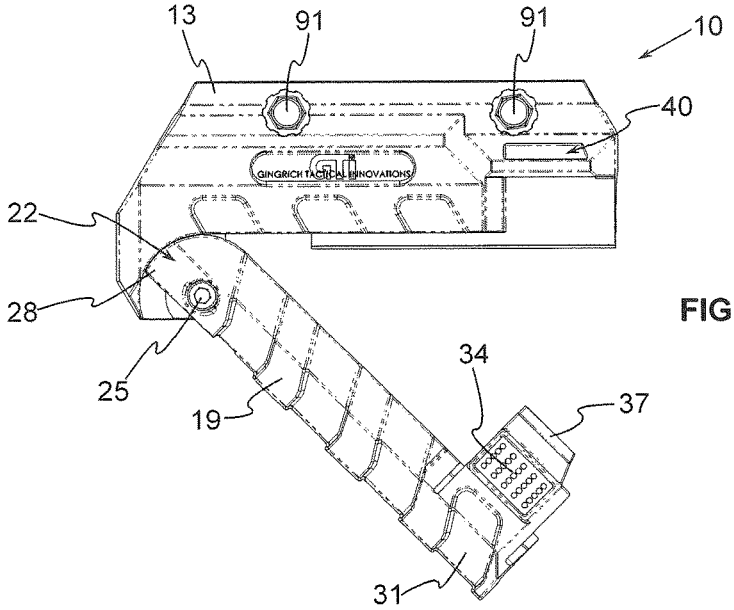
FIG. 1 is a side elevational view of the adaptor of the present invention in the open position.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or of rotation, as appropriate.

Figure 2:
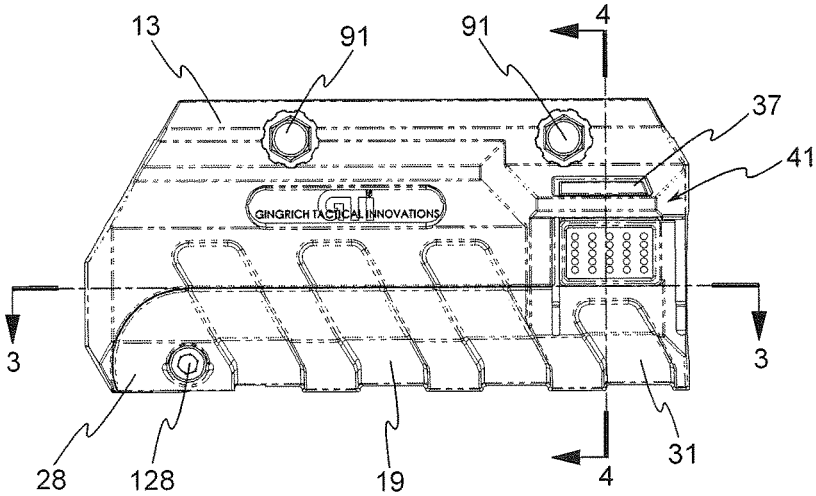
FIG. 2 is a side elevational view of the adaptor shown in FIG. 1 in a closed position.

Referring now to the drawings, and as shown in FIGS. 1-2, an adaptor 10 may be provided with a mounting body 13. Mounting body 13 may be attached to a rail mounting system 157 (FIG. 8) by a plurality of fasteners 91. An arm 19 may be attached to the mounting body 13 at a first attachment 22. The arm 19 may be pivotally attached by a pivot pin 25 as will be evident to those of ordinary skill in the art based on this disclosure. The arm 19 may have a proximal end 28 disposed near the pivot pin 25 and a distal end 31 disposed opposite from the proximal end 28. The distal end 31 may be provided with a projecting portion 34. The projecting portion 34 may be provided with a locking tab 37. The locking tab 37 and projecting portion 34 may be formed from a resilient thermoplastic material such that the locking tab 37 is capable of flexing inward when the arm 19 is rotated up (counterclockwise in FIG. 1) into position in the mounting body 13. The locking tab 37 flexes inward until it aligns with an opening 40 formed in the mounting body 13. When the locking tab 37 aligns with the opening 40 it deflects outward into the opening 40 to form a second attachment 41. When the tab 37 is deflected outward inside the opening 40 it prevents the arm 19 from moving relative to the mounting body 13 and locks the arm 19 into a fixed position shown in FIG. 2.

Figure 3:
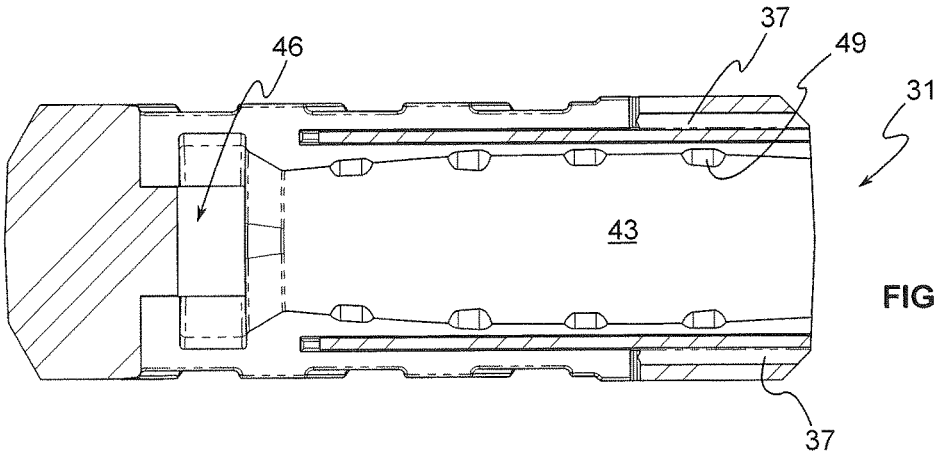
FIG. 3 is a cross-sectional view taken along lines 3-3 of FIG. 2.

Turning to FIG. 3, the arm 19 has an inner surface 43 that may be curved. The inner surface 43 extends from the distal end 31 toward the opposite end. A recessed portion 46 is disposed adjacent to the inner surface 43. The recessed portion 46 may be sized to receive the butt cap 175 on a knife 160 as will described in detail herein. The surface 43 may be provided with a plurality of grooves 49 defined therein. The grooves 49 may be spaced apart in the longitudinal direction.

Figure 4:
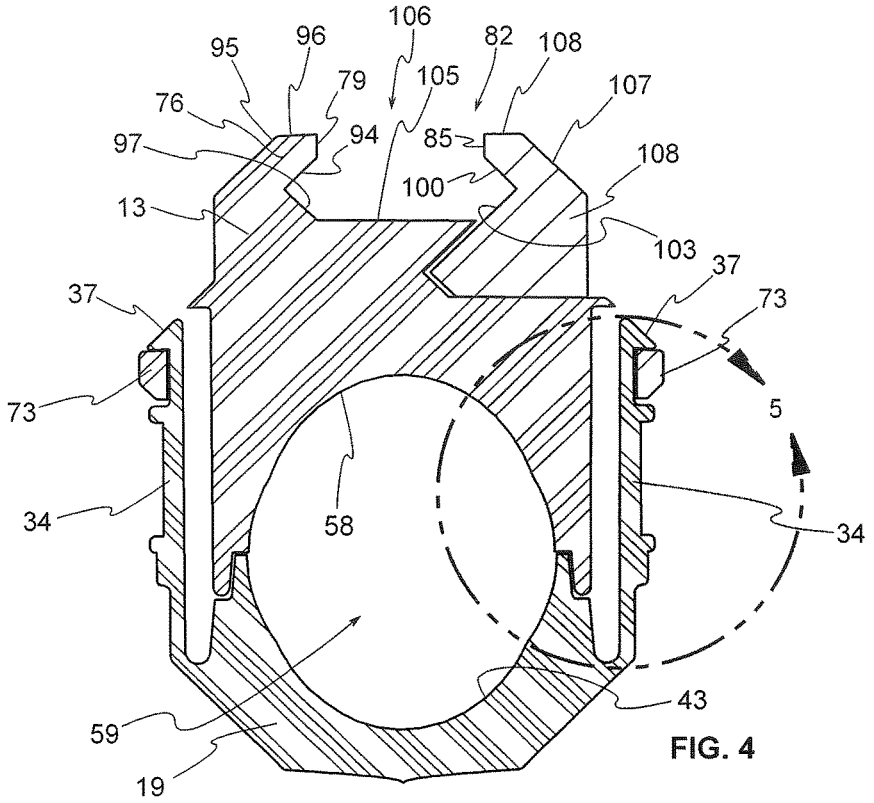
FIG. 4 is a cross-sectional view taken along lines 4-4 of FIG. 2.
Figure 5:
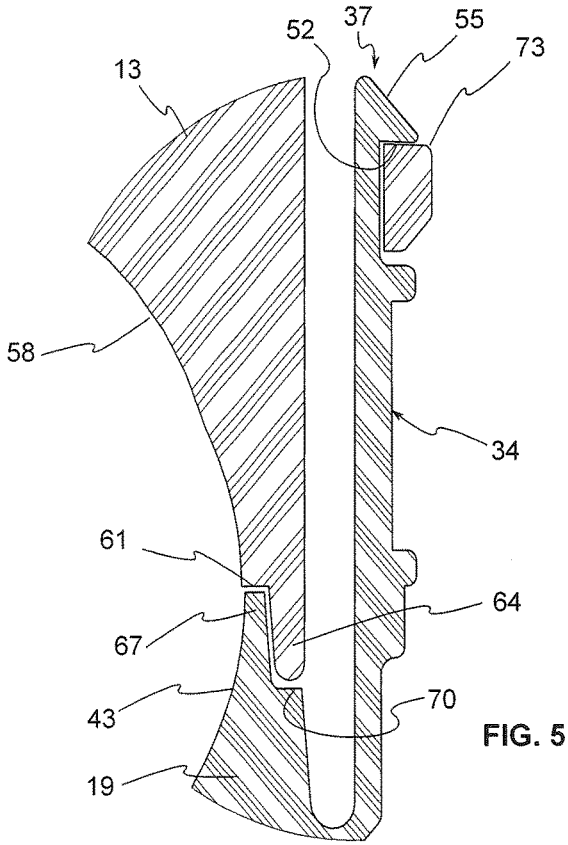
FIG. 5 is a detailed cross-sectional view of a portion of FIG. 4.

Referring to FIGS. 4-5, arm 19 may include a locking tab 37 on opposite sides. The locking tab 37 has a shoulder 52 and an angled portion 55. The locking tab 37 is mounted on the projecting portion 34. The projecting portion 34 is resilient and capable of flexing inward such that the angled portion 55 can slide past bar 73 on the mounting body 13 until the angled portion 55 reaches an opening 40 (best shown in FIG. 8) formed in the mounting body 13. When the locking tab 37 is disposed in alignment with the opening 40, the projecting portion 34 springs outward and the shoulder 52 engages with bar 73 (as best shown in FIG. 5) to lock the arm 19 into position relative to the mounting body 13. Returning to FIG. 4, the inner surface 43 of the arm 19 and the inner surface 58 of the mounting body 13 combine to form an elongate cavity 59 that may have an oval cross section. The cavity 59 is sized to fit the knife 160 as described in greater detail herein.

In FIG. 5, the inner surface 58 of the mounting body 13 extends to a shoulder 61 that is formed at an edge where the mounting body 13 and arm 19 are disposed in close proximity when the arm 19 is engaged with the mounting body 13. The shoulder 61 is formed between a projecting portion 64 and the inner surface 58. The arm 19 may be formed with a corresponding projecting portion 67 that abuts with the shoulder 61 when the arm 19 is engaged with the mounting body 13. The arm 19 is also provided with a shoulder 70 that receives the projecting portion 64. The locking tab 37 engages with a bar 73 disposed on the mounting body 13. The bar 73 borders the opening 40 that receives the locking tab 37.

Returning to FIG. 4, the mounting body 13 may be formed at the top with a projecting member 76 having surfaces forming a portion of a channel 106 for receiving a rail on a rail mounting system for a firearm as will be described in greater detail herein. Surface 79 borders an opening 82 and is disposed in facing relation with surface 85 on a cooperating member 88 that may be attached to the mounting body 13 by a fastener 91 (best shown in FIGS. 6-8) as described in detail herein. Additional surfaces 94 and 97 on the mounting body 13 cooperate with surfaces 100 and 103 on the cooperating member 88 and top surface 105 to form the channel 106 for receiving the rail of a rail mounting system 157. Mounting body 13 includes angled outer surfaces 95, 96; and cooperating member 88 may include angled outer surfaces 107, 108.

Figure 6:
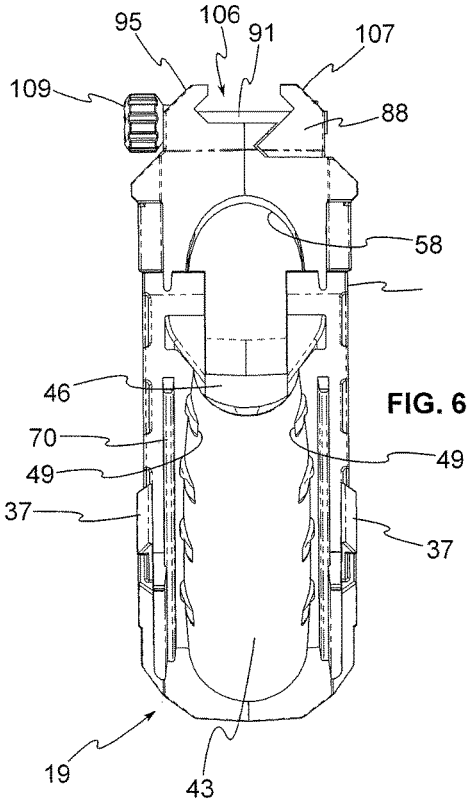
FIG. 6 is a front perspective view of the adaptor in the open position.
Figure 7:
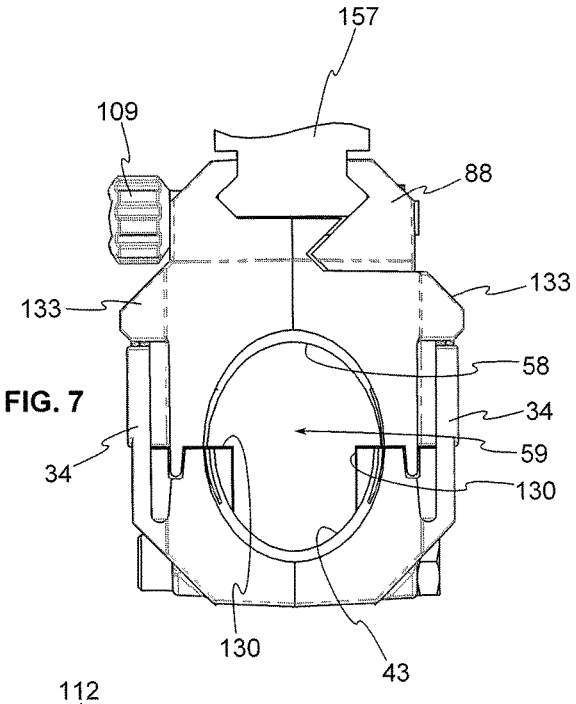
FIG. 7 is a front elevational view of the adaptor of FIG. 6 attached to a rail system.
Figure 8:
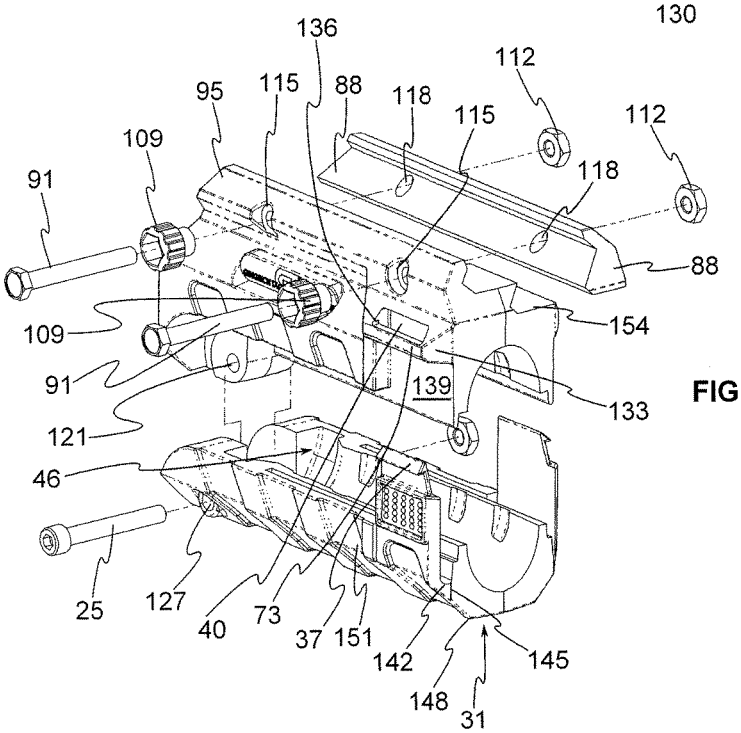
FIG. 8 is an exploded view of the adaptor of the present invention.

Referring to FIGS. 6-8, and initially to FIG. 8 the fastener 91 may include a thumbwheel head 109 mounted or integrally formed at one end. The opposite end of the fastener 91 may be secured by a nut 112. The mounting body 13 has a plurality of openings 115 for receiving the fastener 91. The cooperating member 88 has a plurality of openings 118 for receiving the fastener 91. The mounting body 13 may also include an opening 121 for receiving the pivot pin 25. The arm 19 has an opening 127 that aligns with the opening 121 and receives the pivot pin 25 to form the first attachment 22 (FIG. 1). The distal end 31 of the arm 19 pivots about the pivot axis 128 (normal to the page in FIG. 2). The arm 19 may be designed to rotate counterclockwise about the pivot axis 128 from the open position shown in FIG. 1 to the closed position shown in FIG. 2. When the arm 19 is rotated counterclockwise about the pivot axis 128, the angled portion 55 of the locking tab 37 slides across the bar 73. As the arm 19 rotates, the bar 73 deflects the projecting portion 34 inward to allow the locking tab 37 to slide across the bar 73. When the angled portion 55 clears the bar 73, the locking tab 37 springs outward into the opening 40 according to the elastic properties of the resilient material forming the projecting portion 34. Once the locking tab 37 springs outward the shoulder 52 of the locking tab 37 engages with the bar 73 to prevent any additional movement of the arm 19 relative to the mounting body 13. To release the arm 19 from the mounting body 13, the locking tabs 37 are pushed inward until the shoulder 52 of the locking tab 37 clears the bar 73. It will be evident to those of ordinary skill in the art based on this disclosure, that the arm 19 can be directly attached to the mounting body 13 without a pivotal attachment. Accordingly, the arm 19 may also be attached to the mounting body 13 through translational motion. In one example, the mounting body 13 could be provided with bars 73 and openings 40 in the front and rear of the mounting body 13. The arm 19 could be provided with projecting portions 34 having locking tabs 37 at both the front and rear and the arm 19 could be attached to the mounting body 13 by means of translational motion. Other mechanisms for mounting the arm 19 to the mounting body 13 will also be evident to those of ordinary skill in the art based on this disclosure.

Turning to FIG. 6, the arm 19 is shown in the open position. The plurality of grooves 49 may be formed along the length of the inner surface 43. A plurality of projecting portions 130 may extend outward from the inner surface 43. The projections 130 are best shown in FIG. 7. The grooves 49 may be provided to receive O-rings 178 (FIG. 11) attached to the handle 166 of the knife 160 such as a KA-BAR brand fixed blade knife. As shown in FIG. 7, the projections 130 may extend into the channel 59 and make contact with the handle of the knife to prevent it from sliding or moving inside the channel 59. Returning to FIG. 6, at the back of the arm 19 the recessed portion 46 may be designed to receive the butt cap 175 (FIG. 10) of the knife 160. The shoulder 70 on the arm 19 extends along the length of the arm 19. The inner surface 58 of the mounting body 13 combines with the inner surface 43 of the arm 19 to form the channel 59.

Returning to FIG. 8, the mechanism for locking the arm 19 into position relative to the mounting body 13 is shown in greater detail. The bar 73 is disposed in spaced apart relation from the side of the mounting body 13 and is supported at opposite ends by supports 133 extending from a side wall 139 of the mounting body 13. The projecting portion 34 may be cantilevered such that a lower portion 142 may attach to a portion 145 of the base 148 of the arm 19. The projecting portion 34 extends approximately parallel to the side wall 151 of the arm 19. The cantilever arrangement of the projecting portion 34 provides the projecting portion 34 with the ability to flex toward and away from the arm 19 according to the material properties. The arm 19 may be constructed from a molded plastic with a thickness where the projection portion 34 attaches to the arm 19 that is thick enough to be flexible yet resilient such that after bending the projecting portion 34 returns to its original shape. The material is also sufficiently thick to avoid breaking. At the top of the figure, the cooperating member 88 is an elongate generally wedge shaped member that is received on a shelf 154 that is formed in the top of the mounting body 13. As best shown in FIG. 7, the cooperating member 88 fits onto the shelf and nests into an opening formed in the top of the mounting body 13. When the cooperating member 88 is attached to the mounting body 13 by means of the fastener 91, the system can be supported from a rail mounting system 157. The rail mounting system 157 may comprise a picatinny system or any other system for mounting attachments on a rail disposed on a firearm.

Figure 9:
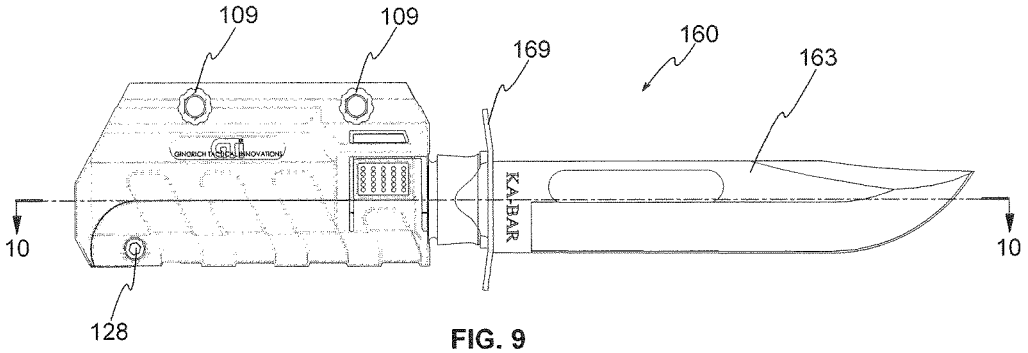
FIG. 9 is a left side elevational view of the adaptor of the present invention holding a fixed blade knife.
Figure 10:
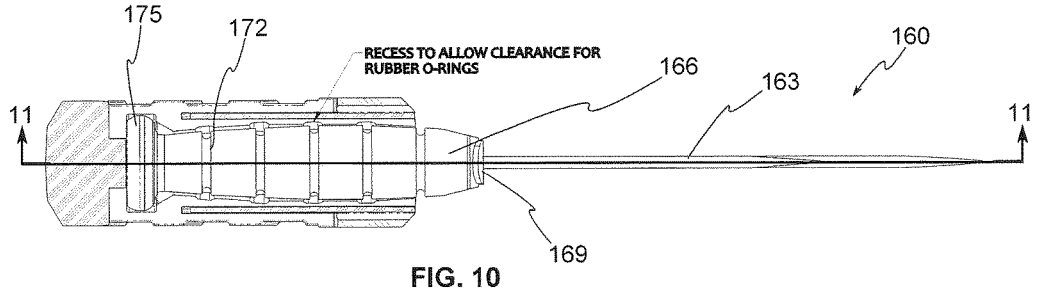
FIG. 10 is a cross-sectional view taken along lines 10-10 of FIG. 9.
Figure 11:
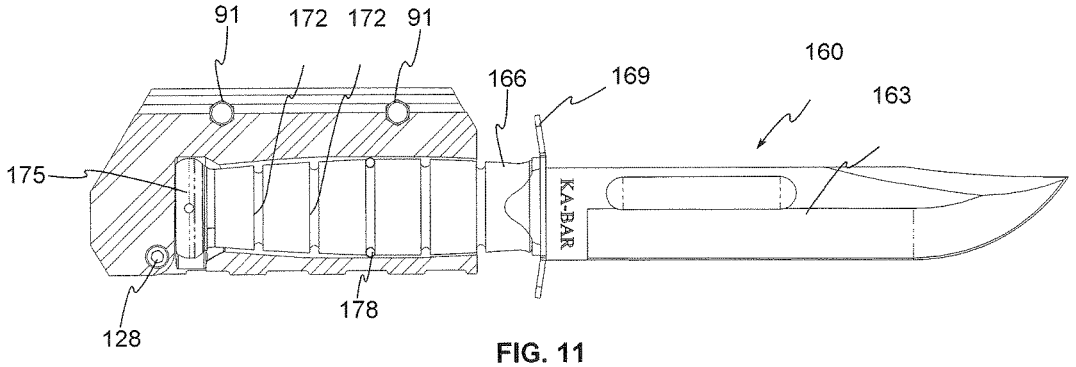
FIG. 11 is a cross-sectional view taken along lines 11-11 of FIG. 10.

Turning to FIGS. 9-11, a fixed blade knife 160 is shown in position in the adapter 10. The knife 160 has a blade 163, a handle 166 (FIGS. 10-11), and a bolster 169. It will be evident to those of ordinary skill in the art based on this disclosure that a locking blade knife may also be suitable for use with the adaptor 10 of the present invention. The knife 160 may be a KA-BAR brand fixed blade knife with a plurality of grooves 172 spaced apart along the length of the handle 166. A butt cap 175 may be disposed at the end of the handle 166. The grooves 172 may be provided with O-rings 178 (FIG. 11) that cooperate with the grooves 49 along the length of the adapter 10 to provide a secure fit and to help prevent the knife 160 from sliding or rotating inside channel 59. The butt cap 175 may be received in the recessed portion 46. The recessed portion 46 holds the butt cap 175 and prevents axial movement of the knife 160 along the longitudinal axis inside cavity 59.

In FIG. 11, the pivot point 128 is shown. Also the fasteners 91 are shown at the top of the figure.

Figure 12:
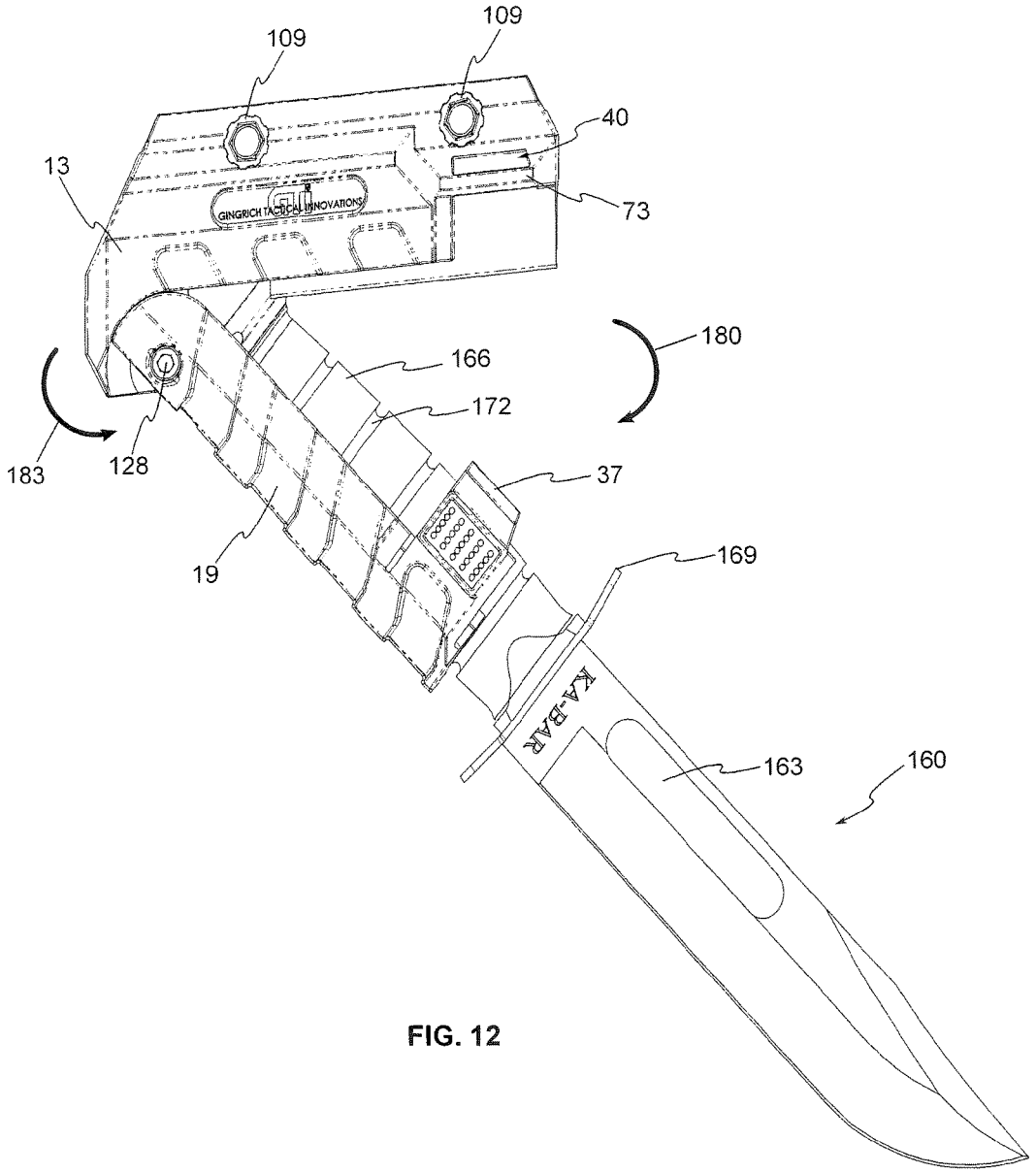
FIG. 12 is an elevational view of the adaptor of the present invention shown in an open position with a fixed blade knife disposed therein.

Turning to FIG. 12, the arm 19 is shown in the open position where the locking tabs 37 have been released from engagement with the bars 73 and the arm 19 has been rotated clockwise in the direction of arrow 180. The arm 19 may engage with the majority of the handle 166 but leave clearance for the bolster 169 which is disposed outside of the adapter 10. From the position shown, the arm 19 is rotated counterclockwise in the direction of arrow 183 to secure the knife 160 in position. The angled portion 55 of locking tab 37 engages with the bar 73 and the projecting portion 34 deflects inward until the angled portion 55 clears the bar 73. At that point the material properties of the projecting portion 34 cause it to spring into position with the shoulder 52 engaged with the bar 73 as best shown in FIG. 5. In this position, the adapter 10 is locked into position with the arm 19 and the mounting body 13 forming the cavity 59 that receives the knife 160. The adapter 10 is mounted on rail system 157 by means of the thumbwheel heads 109 on fasteners 91. The rail is elongate and has a generally T-shaped cross section that mates with groove 106 to hold adapter 10 securely in position on the rail. The rail has gaps along its length to provide clearance for receiving fasteners 91 as will be described in greater detail herein.

Figure 13:
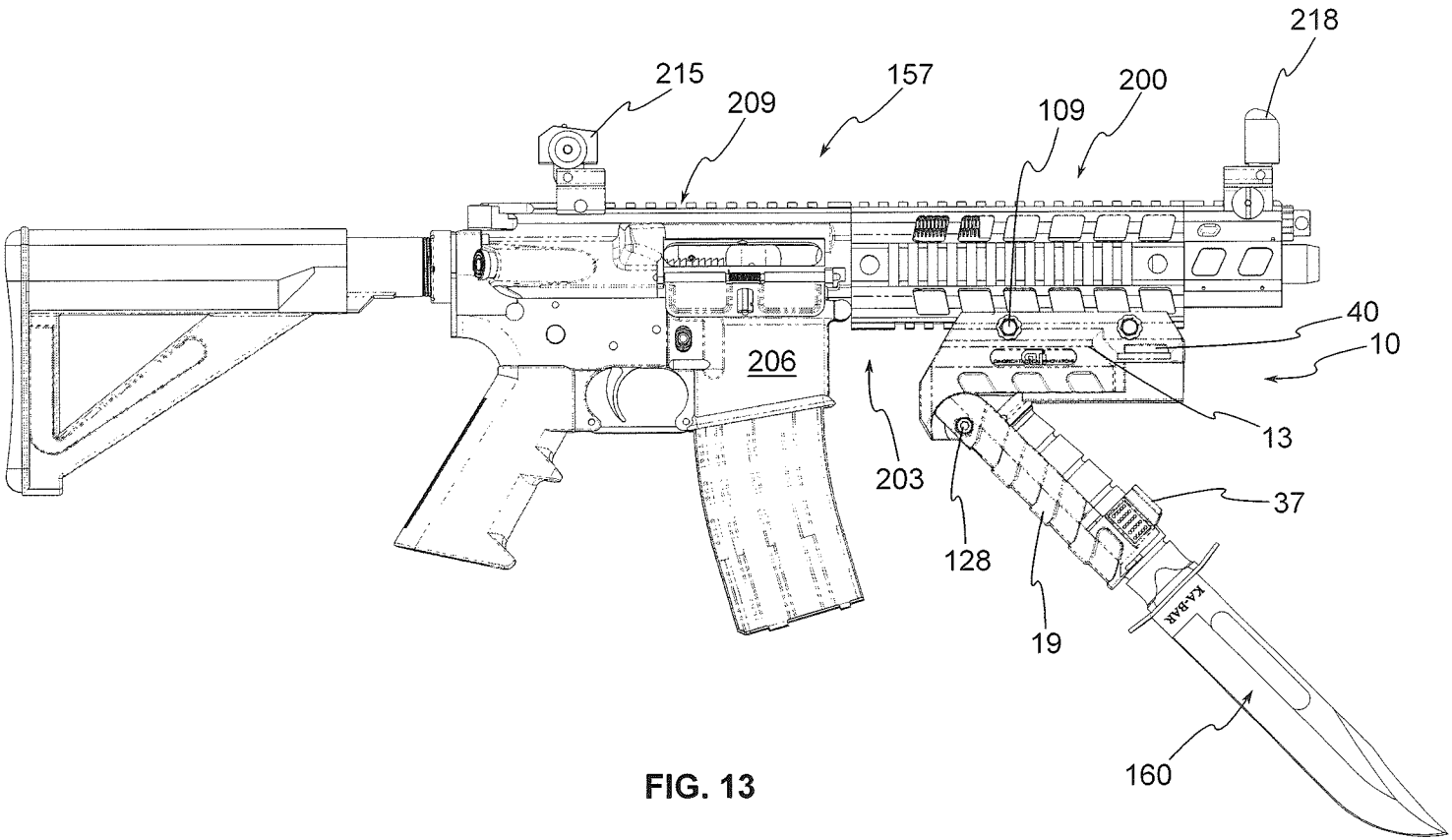
FIG. 13 is a side elevational view of a firearm with an adaptor of the present invention mounted on a rail system and shown in the open position with a fixed blade knife disposed therein.
Figure 14:
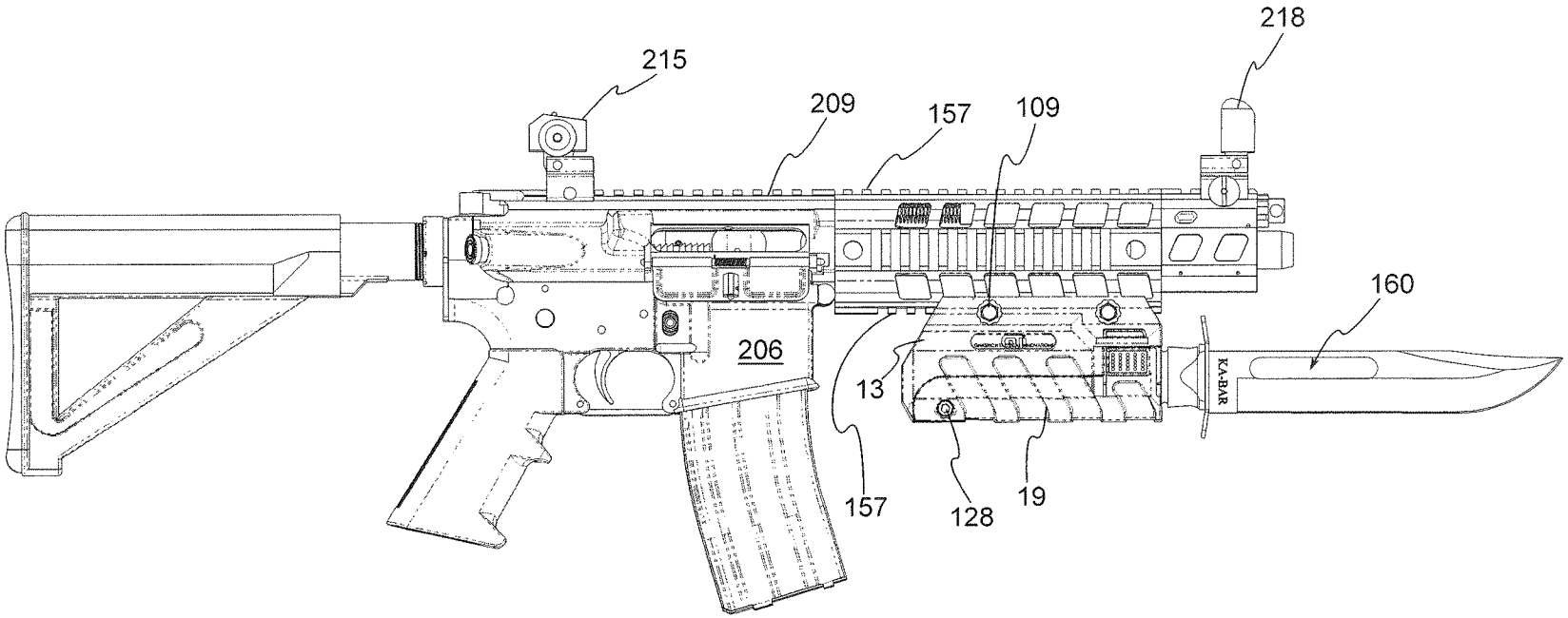
FIG. 14 is a side elevational view of a firearm with an adaptor of the present invention mounted on a rail system and shown in the closed position.

Turning to FIGS. 13-14, the rail mounting system 157 is shown along the top and bottom surfaces 200, 203 of a large caliber firearm 206 such as an M4 Carbine/M16 platform. The rail mounting system 157 may comprise a series of ridges with a T-shaped cross-section (best shown in FIG. 7). The ridges are interspersed with flat spacing slots 209. The top of the mounting body 13 slides over the rail 157 as best shown in FIG. 7. The mounting body 13 is locked into position on the rail 157 by sliding fastener 91 through the openings in the mounting body 13 and the cooperating member 88 and through the slot 209. The fastener 91 is locked in place by means of the thumbwheel 109 and the nut 112. The rail systems were originally intended for mounting scopes on top of the receivers of large caliber rifles but the uses have expanded to include accessories such as tactical lights, laser aiming modules, night vision devices, reflex sights, foregrips, bipods, and bayonets. In FIG. 13, a pair of accessories 215, 218 are mounted to the rail system 157 on the top of the firearm. The adapter 10 is mounted on the opposite side of the barrel. The adapter 10 is shown in the open position with the knife 160 supported on the inner surface 43 of the arm 19. The arm 19 may pivot toward the mounting body 13 as described above until the locking tab 37 is seated in the opening 40 and the shoulder 52 is engaged with the bar 73 as shown in FIG. 14.

The present invention contemplates that many changes and modifications may be made. Therefore, while the presently-preferred form of the adaptor has been shown and described, and several modifications and alternatives discussed, persons skilled in this art will readily appreciate that various additional changes and modifications may be made without departing from the spirit of the invention, as defined and differentiated by the following claims.

The invention claimed is:

1. An adaptor for receiving a knife having a blade and a handle, the adaptor comprising:

a mounting body configured to operatively attach to a rail system of a firearm, the firearm having a barrel with a longitudinal axis; and, an arm attached to the mounting body at a first attachment, the arm configured and arranged to move between an open position and a closed position, the arm having a first surface that in combination with a second surface on the mounting body forms a cavity for holding the knife in a locked position with the blade of the knife extending outside of the cavity when the arm is attached to the mounting body at a second attachment, the knife having a longitudinal axis and the longitudinal axis of the knife being disposed substantially in parallel with the longitudinal axis of the barrel when the arm is in the closed position.

2. The adaptor of claim 1, wherein the arm has a first end that is pivotally attached to the mounting body at the first attachment.

3. An adaptor for receiving a knife, the adaptor comprising:

a mounting body configured to operatively attach to a rail system of a firearm; an arm attached to the mounting body at a first attachment, the arm configured and arranged to move between an open position and a closed position, the arm having a first surface that in combination with a second surface on the mounting body forms a cavity for holding the knife in a locked position when the arm is attached to the mounting body at a second attachment; and, wherein the first surface has a recessed portion for receiving a butt cap on the knife.

4. The adaptor of claim 3, wherein one of the arm and the mounting body further comprises at least one locking tab.

5. The adaptor of claim 4, wherein the other of the arm and the mounting body further comprises an opening for receiving the locking tab.

6. The adaptor of claim 3, wherein the first surface and the second surface have at least one groove defined therein for receiving at least one O-ring disposed around a handle of the knife.

7. The adaptor of claim 3, wherein the mounting body receives a cooperating member such that a portion of the mounting body and a corresponding portion of the cooperating member form a channel for receiving a rail when the cooperating member is attached to the mounting body.

8. The adaptor of claim 3, wherein the mounting body has an edge disposed adjacent to a recessed portion forming a shoulder.

9. The adaptor of claim 8, wherein the arm has an edge configured to engage with the shoulder when the arm is attached to the mounting body.

10. The adaptor of claim 3, wherein the arm comprises transversely spaced protrusions configured to grip a handle of the knife.

11. The adaptor of claim 3, wherein the knife is a fixed blade knife.

12. The adaptor of claim 3, wherein the knife is a knife with a locking blade.

13. An adaptor for receiving a fixed blade knife having a handle, the adaptor comprising:

a mounting body configured to operatively attach to a rail system on a firearm, the firearm having a barrel with a longitudinal axis, the mounting body having a first member and a second member configured to form a channel for receiving a rail when the second member is attached to the first member, the second member configured and arranged to attach to the first member; and, an arm attached to the mounting body at a first attachment, the arm configured and arranged to move between an open position and a closed position, the arm having a first surface that in combination with a second surface on the mounting body forms a cavity for holding the fixed blade knife in a locked position with the blade extending outside of the cavity when the arm is attached to the mounting body at a second attachment, the arm receiving the fixed blade knife on the first surface when the arm is in the open position, the fixed blade knife having a longitudinal axis and the longitudinal axis of the fixed blade knife being disposed substantially in parallel with the longitudinal axis of the barrel when the arm is in the closed position.

14. The adaptor of claim 13, wherein one of the arm and mounting body have a locking tab and the other of the arm and the mounting body have a slot for receiving the locking tab.

15. The adaptor of claim 13, wherein the first surface has a recessed portion for receiving a butt cap on the knife.

16. The adaptor of claim 13, wherein the first surface and the second surface have at least one groove defined therein for receiving at least one O-ring disposed around the handle of the knife.

17. The adaptor of claim 13, wherein the mounting body has an edge disposed adjacent to a recessed portion forming a shoulder.

18. The adaptor of claim 17, wherein the arm has an edge configured to engage with the shoulder when the arm is attached to the mounting body.

19. A weapon system, comprising:

a firearm having a barrel with a longitudinal axis, the firearm having a rail disposed thereon;

an adaptor configured and arranged to be mounted on the rail, the adaptor having an arm attached to a mounting body, the mounting body configured and arranged to be attached directly to the rail, the arm configured and arranged to move between an open position and a closed position, the arm having a first surface that in combination with a second surface on the mounting body forms a cavity when the arm is attached to the mounting body; and, a knife having a blade and a handle, the knife disposed on the first surface of the arm when the arm is in the open position and fixedly held in the cavity with the blade extending outside of the cavity when the arm is moved into the closed position, the knife having a longitudinal axis and the longitudinal axis of the knife being disposed substantially in parallel with the longitudinal axis of the barrel when the arm is in the closed position.

20. The system of claim 19, wherein the first surface and the second surface have at least one groove defined therein for receiving at least one O-ring disposed around the handle of the knife.

21. The system of claim 19, wherein the mounting body receives a cooperating member such that a portion of the mounting body and a corresponding portion of the cooperating member form a channel for receiving a rail when the cooperating member is attached to the mounting body.

* * * * *